US009283150B2

(12) United States Patent
Bujalski et al.

(10) Patent No.: US 9,283,150 B2
(45) Date of Patent: Mar. 15, 2016

(54) PILL DISPENSING SYSTEM

(71) Applicant: HB Clouds LLC, Boynton Beach, FL (US)

(72) Inventors: Joseph B. Bujalski, Boynton Beach, FL (US); James Klino, Lockport, NY (US); Jeffery Heitzenrater, Lyndonville, NY (US); Christopher Sean Wronski, Lockport, NY (US)

(73) Assignee: HB Clouds LLC, Boynton Beach, FL (US)

( * ) Notice: Subject to any disclaimer, the term of this patent is extended or adjusted under 35 U.S.C. 154(b) by 39 days.

(21) Appl. No.: 14/293,718

(22) Filed: Jun. 2, 2014

(65) Prior Publication Data

US 2015/0342830 A1 Dec. 3, 2015

(51) Int. Cl.
*A61J 7/04* (2006.01)
*B65D 83/04* (2006.01)

(52) U.S. Cl.
CPC ..... *A61J 7/0445* (2015.05); *A61J 7/0472* (2013.01); *B65D 83/0409* (2013.01)

(58) Field of Classification Search
CPC ..... A61J 7/0445; A61J 7/0472
USPC ..... 221/2, 3, 4, 15
See application file for complete search history.

(56) References Cited

U.S. PATENT DOCUMENTS

| | | | | |
|---|---|---|---|---|
| D128,936 | S | 8/1941 | Foley | |
| 3,687,336 | A | 8/1972 | Gayle | |
| 3,722,739 | A | 3/1973 | Blumberg | |
| 4,207,992 | A | 6/1980 | Brown | |
| D279,864 | S | 7/1985 | Ridgley | |
| 4,555,044 | A | 11/1985 | Pearo | |
| 5,323,929 | A * | 6/1994 | Marlar | A61J 7/0409 221/121 |
| 5,372,276 | A | 12/1994 | Daneshvar | |
| 5,609,270 | A | 3/1997 | Walker | |
| 5,810,198 | A | 9/1998 | Townsend et al. | |
| 7,359,765 | B2 * | 4/2008 | Varvarelis | A61J 7/0481 221/265 |
| 7,719,927 | B1 | 5/2010 | Robinson et al. | |
| D640,050 | S | 6/2011 | Barrass | |
| D658,362 | S | 5/2012 | Nassiri et al. | |
| 8,446,799 | B2 | 5/2013 | Burke, Jr. et al. | |
| 8,469,194 | B2 | 6/2013 | Johnson et al. | |

(Continued)

FOREIGN PATENT DOCUMENTS

FR 2739083 A1 3/1997

OTHER PUBLICATIONS

Med-E-Lert Automatic Pill Dispenser with Alarm. Available at http://www.activeforever.com/med-e-lert-automatic-pill-dispenser-with-alarm#.U7r5bfldWCk. (Last accessed Jul. 7, 2014).

(Continued)

*Primary Examiner* — Patrick Mackey
(74) *Attorney, Agent, or Firm* — Simpson & Simpson, PLLC

(57) ABSTRACT

A pill dispenser comprising a container operatively arranged to hold at least one pill, a cap/timer assembly rotatably secured to the container, the cap/timer assembly arranged to be set to a time interval for dispensing the at least one pill, means for alerting a user when the timer has been set to the time interval, and a dispenser housed within the container and the cap, the dispenser operatively arranged to dispense only one pill at the beginning of the time interval, and to prevent dispensing until the time interval has elapsed. The dispenser also includes an audible alert to indicate that a pill has been dispensed.

21 Claims, 15 Drawing Sheets

(56) References Cited

U.S. PATENT DOCUMENTS

| | | | | |
|---|---|---|---|---|
| 8,622,241 | B2 * | 1/2014 | Geboers | A61J 7/0084 206/533 |
| 8,666,543 | B2 * | 3/2014 | MacVittie | B65D 83/0409 221/241 |
| 8,700,212 | B1 | 4/2014 | Bruno et al. | |
| 8,752,728 | B2 * | 6/2014 | Tignanelli | A61J 1/03 221/15 |
| 8,936,175 | B1 * | 1/2015 | Song | A61J 7/0472 221/15 |
| 2008/0017658 | A1 | 1/2008 | Wright | |
| 2008/0054008 | A1 | 3/2008 | Wright | |
| 2011/0259910 | A1 | 10/2011 | Knudsen | |
| 2011/0272297 | A1 | 11/2011 | Ziemba et al. | |
| 2013/0116818 | A1 * | 5/2013 | Hamilton | A61J 7/04 700/236 |
| 2013/0153608 | A1 | 6/2013 | Amin et al. | |

OTHER PUBLICATIONS

Med-E-Lert Easy Set-Up Manual. Available at ActiveForever.com. Scottsdale, AZ. (Last accessed Jul. 7, 2014).

* cited by examiner 41A
33
32
12
41
50
55
42
13
31A
31C
34
31B
90
11
31

33
12
34
32
41
55
13
54
52
53
R1
31
66
R4
R2
73
68
63
11
64

PILL DISPENSING SYSTEM

FIELD OF THE INVENTION

The invention relates generally to pill dispensers and, more specifically, to pill dispensers that dispense only one pill at the beginning of a time interval and prevent dispensing until the time interval has elapsed.

BACKGROUND OF THE INVENTION

Prescription medications are strictly monitored in hospitals and other medical facilities to prevent overmedication and illegal distribution of such medications. However, patients are also prescribed medications to be taken at home in an unsupervised manner. When unsupervised, it is not uncommon for a patient to miss a dose of medication. Alternatively, more tragically, when unsupervised, a patient can mistakenly overdose on a prescribed medication because he/she forgot they already took a dose.

Patients can obtain prescription medications from pharmacies where the medications are provided in pill packs or bottles. Pill packs are prepared by drug manufacturers. Pill bottles, on the other hand, are used by pharmacies for various pills by different manufacturers. Some pill bottles are equipped with child safety lock mechanisms to prevent children from accessing the medication. However, adults can still access the medication in an uncontrolled manner; thus, adults can still mistakenly overdose on a prescribed medication, especially the elderly.

For example, patients experiencing moderate to severe acute or chronic pain can be prescribed opioids. Opioids are psychoactive chemicals that bind to opioid receptors found in the central and peripheral nervous systems to produce an analgesic (painkilling) effect. Opioids are used as painkillers because patients taking them experience a decreased perception of and reaction to pain and an increase in pain tolerance. Some patients taking opioids also take over-the-counter (OTC) drugs to produce similar therapeutic effects and overmedication can occur. Patients can also overmedicate by taking their medications at shorter intervals than prescribed. Overmedication can cause unintended side effects including death. In 2008, there were 14,800 deaths from prescription painkiller abuse in the United States alone. CDC, Vital Signs: Overdoses of Prescription Opioid Pain Relievers—United States, 1999-2008. MMWR 2011; 60: 1-6. The number of deaths by prescription medication in 2008 was higher than that of cocaine and heroin overdose deaths in the same year. Id.

The fact that prescription medications can be addictive adds to the problem of having prescription medications distributed in an uncontrolled manner. Opioids, for example, produce a strong feeling of euphoria in addition to the painkilling effect, which causes patients and consumers alike to use opioids illegally. Recreational prescription drug use is an ever growing problem.

Others have attempted to prevent overmedication. U.S. Pat. No. 7,719,927 (Robinson et al.) describes a disposable pill bottle including a disposable cap permanently conjoined to the bottle. The disposable pill bottle further includes a locking actuator, alarm, and counter, which are electrically powered. The device keeps track of the time between dosages and alerts the patient with an audible alarm when it is time to medicate. Unfortunately, when the bottle is open, a patient can access all the medication within the bottle; thus, the possibility of unintentional overmedication or illegal distribution still exists.

Additionally, since the device is electrically powered, a dead battery could prevent a patient from receiving their medication.

U.S. Pat. No. 3,722,739 (Blumberg) describes an entirely mechanical means for dispensing pills one-at-a-time after a period of time. The device aims to prevent the premature dispensing of pills. The device is generally circular and has an annular ring of pockets for pills. Additionally, the device includes two annular members that cover the ring of pockets and windows, which register to expose any one pocket. The device is controlled by a timing mechanism, which prevents movement of the inner of the members into register with a further pocket until a pre-set time interval has expired. However, a patient can easily access all the medication contained within the device by simply opening it; thus, the possibility of unintentional overmedication still exists.

Therefore, there is a long-felt need for a pill dispenser that dispenses one pill during a time interval and prevents dispensing and unfettered access until the time interval has elapsed. Additionally, there is a long-felt need for such a pill dispenser that is purely mechanical. A pill dispenser having a removable sleeve is needed so that pharmacists can refill prescriptions and fill new prescriptions using the same device with a new sleeve. Such a pill dispenser that can be adapted to deliver pills of any size is needed. Additionally, a pill dispenser having a hermetic seal to prevent unauthorized access is needed. A pill dispenser having an integrated timer arranged to be set to a time interval and means for alerting a person that the timer has been set to the timer interval and that the time interval has elapsed is needed.

BRIEF SUMMARY OF THE INVENTION

The invention is a pill dispenser comprising a container operatively arranged to hold at least one pill, a cap/timer assembly rotatably secured to the container, the cap/timer assembly arranged to be set to a time interval for dispensing the at least one pill, means for alerting a user when the timer has been set to the time interval, and a dispenser housed within the container and the cap, the dispenser operatively arranged to dispense only one pill at the beginning of the time interval, and to prevent dispensing until the time interval has elapsed.

The invention is a pill dispenser comprising a container operatively arranged to hold at least one pill, a cap/timer assembly rotatably secured to the container, the cap/timer assembly arranged to be set to a time interval for dispensing the at least one pill, a dispenser housed within the container and the cap, the dispenser operatively arranged to dispense only one pill at the beginning of the time interval, and to prevent dispensing until the time interval has elapsed and means for alerting a user when the time interval has elapsed.

The invention is also a method for dispensing a pill from a pill bottle, comprising the steps of: (a) twisting a cap of the pill bottle containing a timer in a first direction such that the cap and the timer are rotated a predetermined amount relative to a container of the pill bottle and an indicator is activated; (b) accessing a pill from an opening in a bottom of the container of said pill bottle; (c) waiting a predetermined amount of time until the cap of the pill bottle returns in a second direction to its original position and the indicator is activated again; and, (d) repeating steps (a) through (c) as needed.

Accordingly, it is a primary purpose of this invention is to provide a pill dispenser that dispenses one pill at the beginning of a time interval and prevents dispensing until the time interval has elapsed.

It is a further object of this invention to provide such a pill dispenser that is purely mechanical and not dependent upon an electrical source for operation.

A further object of this invention is to provide a pill dispenser having a hermetic seal to prevent unauthorized access.

Another object of this invention is to provide a pill dispenser that can be adapted to deliver pills of any size.

It is yet another object of this invention to provide a pill dispenser having an integrated timer arranged to be set to a time interval and means for alerting a person that the timer has been set to the time interval.

Still another object of this invention is to provide a pill dispenser having an integrated timer arranged to be set to a time interval and means for alerting a person that the time interval has elapsed.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and, as such, may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1A:
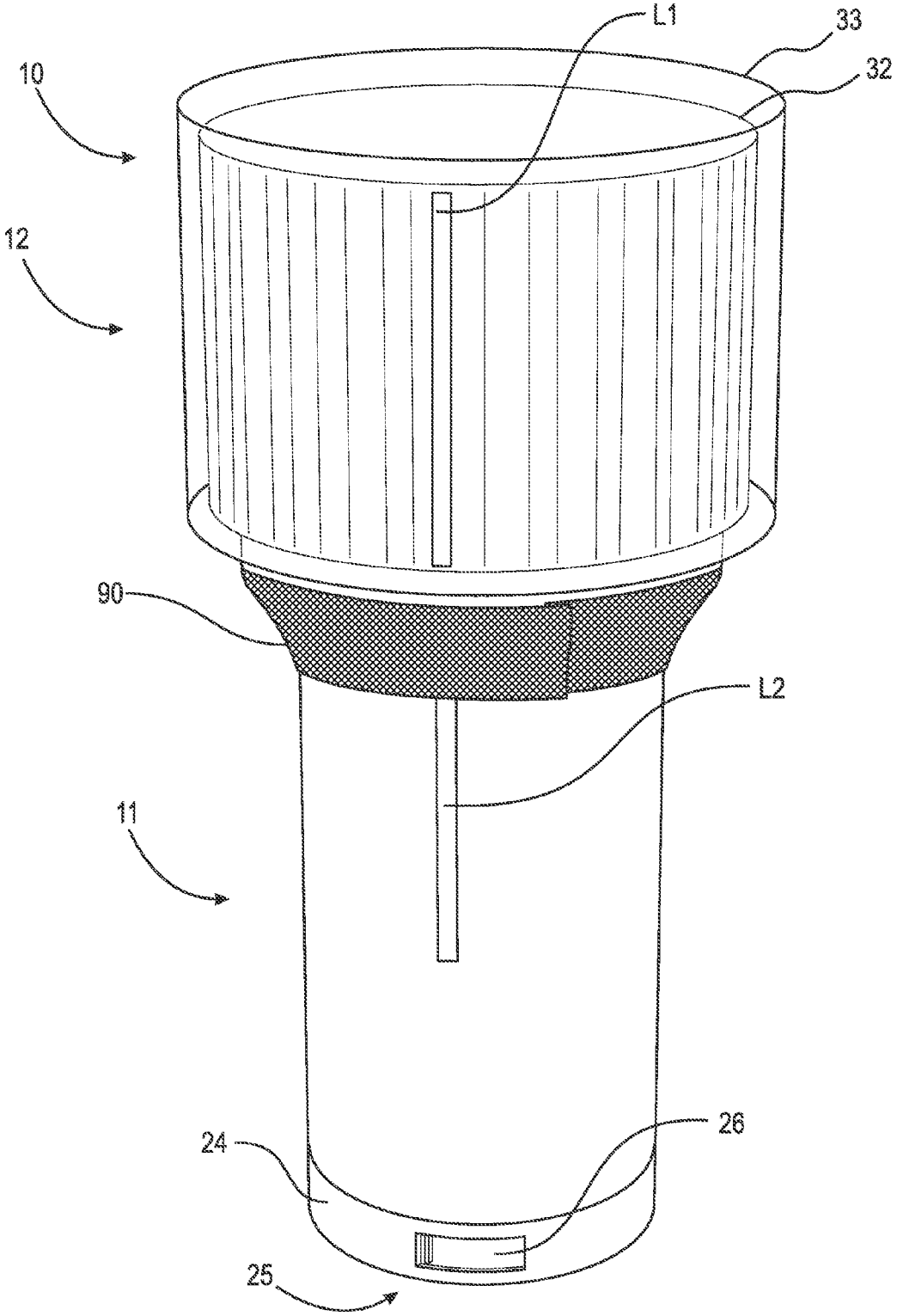
FIG. 1A is a front perspective view of the apparatus of the invention.
Figure 1B:
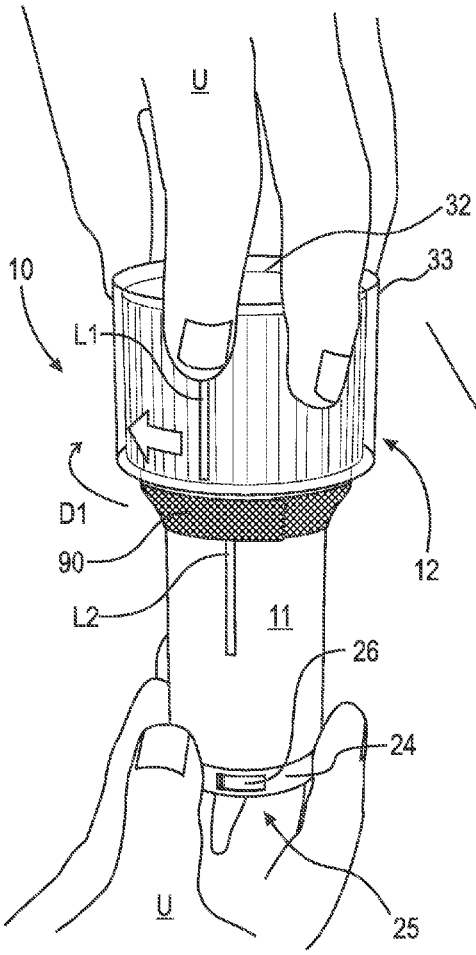
FIG. 1B is a front perspective view of the apparatus shown in FIG. 1A showing a user holding the apparatus and rotating the cap of the apparatus.
Figure 1C:
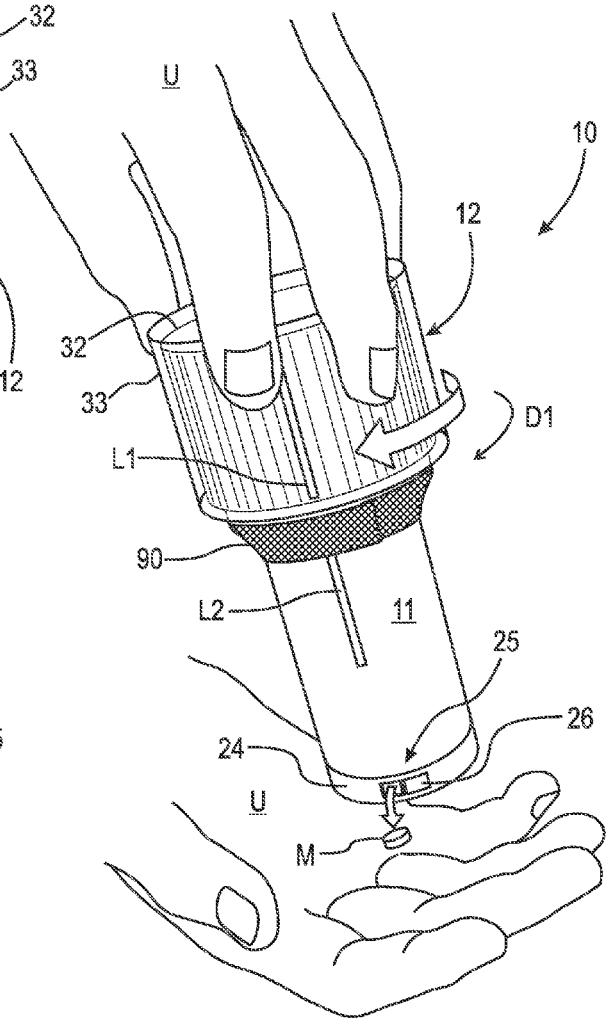
FIG. 1C is a front perspective view of the apparatus shown in FIG. 1A showing the cap of the apparatus fully rotated and a user accessing one pill from the apparatus.

Adverting now to the Figures, FIG. 1A is a front perspective view of apparatus 10, which is a mechanical apparatus for controlling the dispensing of pills, for example, medicaments M (shown in FIG. 1C). Apparatus 10 broadly comprises container 11, cap 12, dispenser assembly 14 (shown in FIGS. 3A and 4A) and base 24. Container 11 includes means for holding at least one pill and means for accessing the at least one pill. Cap 12 is securable to container 11. Cap 12 includes timer 13 (shown in FIGS. 3A and 5A) housed therein. Cap 12 further includes means for setting timer 13 and means for alerting user U (shown in FIGS. 1B and 1C) when a time interval has been set for timer 13 and when the time interval has elapsed. Dispenser assembly 14 is housed within container 11 and cap 12. Dispenser assembly 14 includes means for controlling the dispensing of pills one pill at a time such that once user U accesses a first pill, user U can only access second pill P2 once the set time interval has elapsed.

In a preferred embodiment, apparatus 10 comprises alignment line segments L1 and L2 to indicate either when apparatus 10 is ready to dispense a pill or when a time interval has been set for timer 13. First alignment line segment L1 is affixed to or impressed on the exterior surface of cap 12. Second alignment line segment L2 is affixed to or impressed on the exterior surface of container 11. In a preferred embodiment, alignment line segments L1 and L2 are printed indicia. When apparatus 10 is ready to dispense a pill or when a time interval has been set for timer 13, the alignment line segments L1 and L2 are aligned. In other words, when alignment line segments L1 and L2 are aligned, cap 12 is ready to be rotated with respect to container 11 so that only one pill can be accessed. Similarly, when alignment line segments L1 and L2 are aligned and cap 12 has been fully rotated with respect to container 11, the time interval has been set. In a preferred embodiment, cap 12 comprises inner portion 32 and outer portion 33 (shown in FIG. 2A) such that, as shown in FIG. 1A, alignment line segment L1 on cap 12 is on inner portion 32 and outer portion 33 is transparent or translucent so that user U can see alignment line segment L1 on cap 12 through outer portion 33. Thus, it is seen that the printed indicia line segments L1 and L2 have a functional relationship with the exterior surfaces of cap 12 and container 11, respectively, in that the line segments function to indicate either when cap 12 is ready to be rotated with respect to container 11 or when cap 12 has been fully rotated with respect to container 11.

Base 24 of apparatus 10 further includes opening 25 as shown in FIG. 1A. It should be appreciated that, in a preferred embodiment, base 24 includes door 26 which is slidable along a track within base 24 of container 11. From a resting state, when cap 12 is fully rotated with respect to container 11, one pill is released into base 24 of container 11 and user U can access the one pill via opening 25 and door 26. In an example embodiment, container 11 and cap 12 are cylindrical however, it should be appreciated that container 11 and cap 12 could take any suitable shape, for example, square or rectangular bottles are contemplated.

As shown in FIG. 1B, from the resting state, user U can rotate cap 12 with respect to container 11 in direction D1. In a preferred embodiment, direction D1 is clockwise. When outer portion 33 of cap 12 is rotated in the clockwise direction, inner portion 32 is also rotated clockwise due to the ratcheted engagement between inner portion 32 and outer portion 33 (shown in FIGS. 2A, 2B, and 2C). It should be appreciated that if user U rotates cap 12 counter-clockwise, outer portion 33 rotates freely with respect to inner portion 32 due to the ratcheted engagement between inner portion 32 and outer portion 33. Thus, in a preferred embodiment, in order to rotate cap 12 such that one pill is released into base 24, user U fully rotates cap 12 with respect to container 11 clockwise. The ratcheted engagement prevents user U from tampering with the pre-determined time interval of timer 13. In a preferred embodiment, pill M is only released into base 24 when cap 12 is rotated 360 degrees clockwise with respect to container 11. As shown in FIG. 1C, cap 12 is fully rotated and a time interval has been set for timer 13. It should be appreciated that alignment line segments L1 and L2 are aligned again as they were aligned in the resting state before cap 12 was rotated as shown in FIG. 1A. Once cap 12 is fully rotated, pill M is accessible through opening 25 and door 26. To access pill M, user U slides door 26 within its track.

Figure 2A:
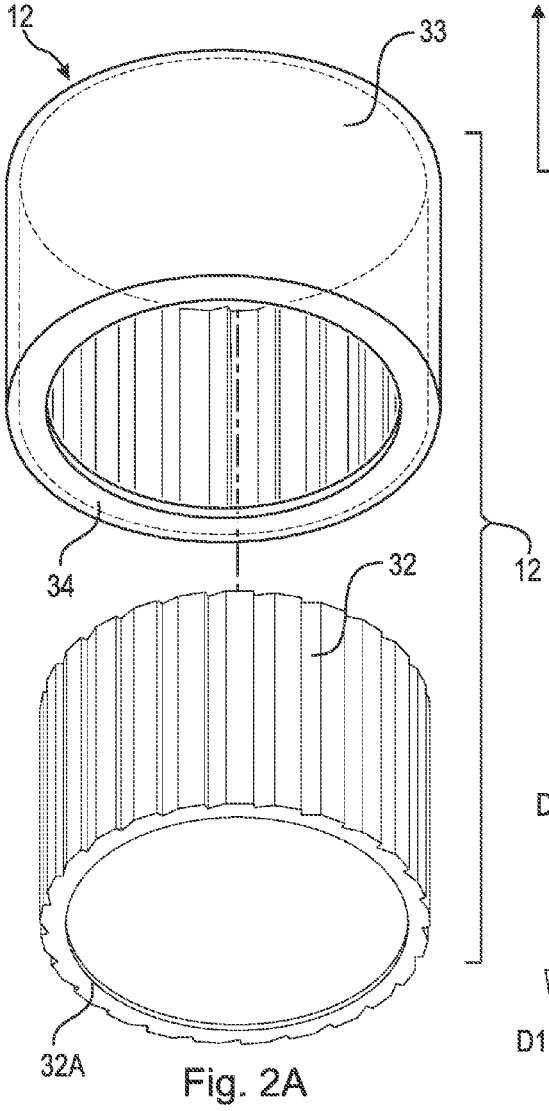
FIG. 2A is an exploded bottom perspective view of the cap of the invention.
Figure 2B:
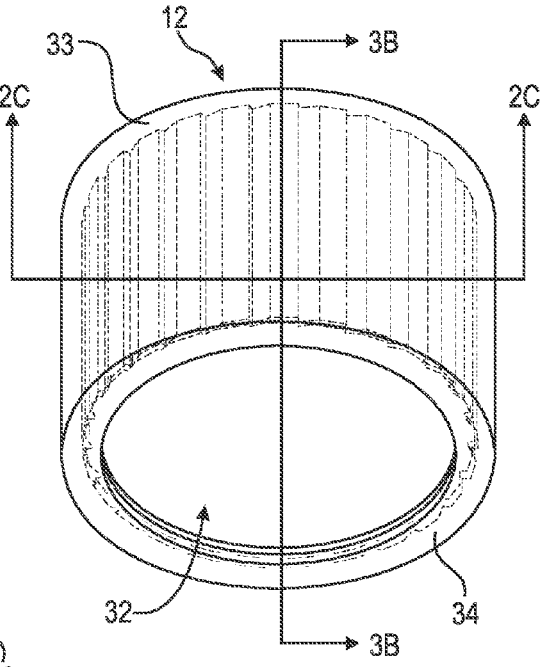
FIG. 2B is a bottom perspective view of the inner and outer portions of the cap of the invention assembled.
Figure 2C:
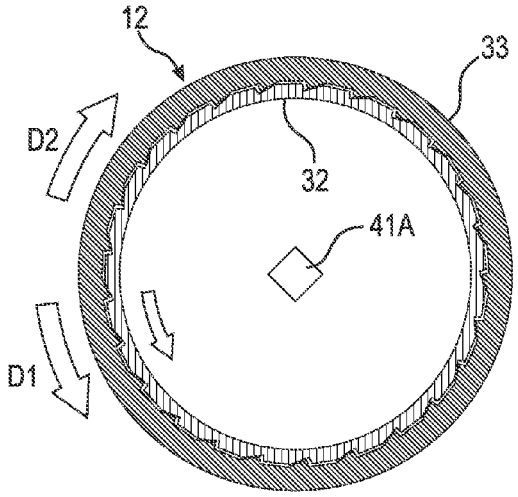
FIG. 2C is a cross-sectional view of the inner and outer portions of the cap shown in FIG. 2B taken generally along line 2C-2C in FIG. 2B.

FIG. 2A shows inner portion 32 exploded from outer portion 33 of cap 12. As described above, outer portion 33 engages inner portion 32 via a ratcheted engagement such that when outer portion 33 is rotated clockwise, inner portion 32 is also rotated clockwise in unison. It should be appreciated that the ratcheted engagement could be arranged such that inner portion 32 is rotatable counter-clockwise. Inner portion 32 also includes lip 32A which protrudes inwardly from the bottom circumference of inner portion 32. FIG. 2B shows inner portion 32 assembled within outer portion 33. Lip 34 protrudes inwardly from the bottom circumference of outer portion 33 and provides support for inner portion 32. FIG. 2C is a cross-sectional view of cap 12 taken generally along line 2C-2C in FIG. 2B. Aperture 41A is formed within the underneath top surface of inner portion 32. In a preferred embodiment, aperture 41A is operatively arranged to receive nut 41 by means of a press fit. As shown in FIG. 2C, outer portion 33 is rotatable along direction D1 and direction D2. In a preferred embodiment, inner portion 32 is only rotatable along direction D1 when outer portion 33 is rotated along direction D1. Outer portion 33 is preferably made of transparent plastic. In a preferred embodiment, cap 12 and container 11 are made of pharmaceutical plastic, for example, high density polyethylene (HDPE) plastic, medium density polyethylene (MDPE) plastic, low density polyethylene (LDPE) plastic, polyethylene terephthalate (PET) plastic, polypropylene (PP) plastic, or polystyrene (PS) plastic which are prepared for use with pharmaceutical products.

Figures 3A, 3B:
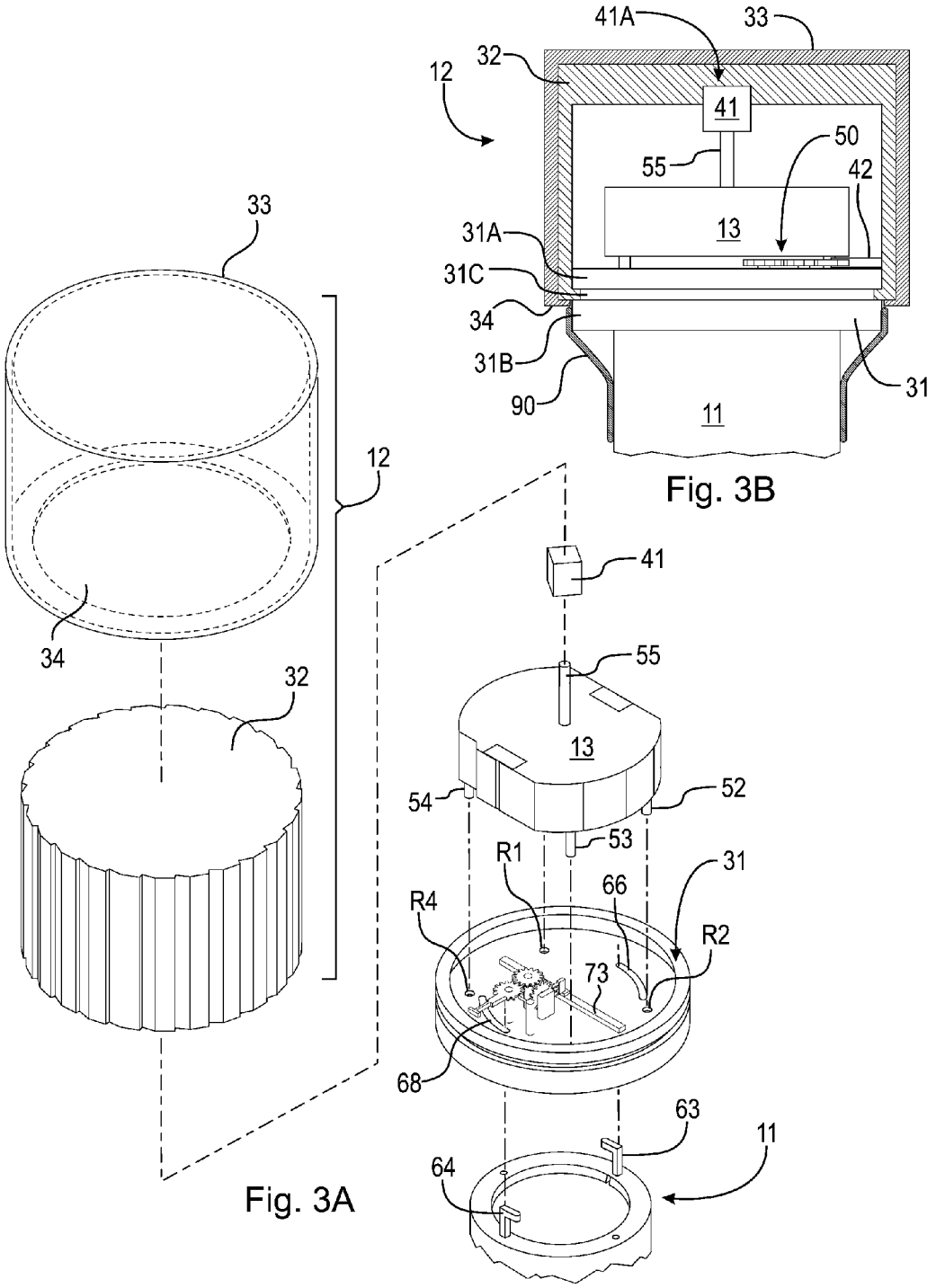
FIG. 3A is an exploded top perspective view of the cap/timer assembly of the invention.
FIG. 3B is a cross-sectional view of the cap/timer assembly shown in FIG. 2B taken generally along line 3B-3B in FIG. 2B.

FIG. 3A shows an exploded top perspective view of the cap/timer assembly of apparatus 10. The cap/timer assembly broadly includes cap 12, nut 41, timer 13, and lateral support 31. As described above, nut 41 is fixedly secured within aperture 41A arranged on the underneath surface of inner portion 32 of cap 12 (shown in FIG. 2C). Nut 41 is arranged to receive and rotate arm 55 of timer 13. Timer 13 includes leg posts 51 (shown in FIG. 5C), 52, 53, and 54 which rest within recesses R1, R2, R3 (shown in FIG. 6A), and R4, respectively, of lateral support 31. It should be appreciated that leg posts 51, 52, 53, and 54 of timer 13 are not secured to recesses R1, R2, R3, and R4 in a preferred embodiment. The cap/timer assembly aligns with container 11 by L-shaped alignment members 63 and 64. Cap 12 and container 11 are secured by seal 90. L-shaped alignment members 63 and 64 engage arcuate slots 66 and 68, respectively. When L-shaped alignment members 63 and 64 are engaged with arcuate slots 66 and 68, respectively, protrusions 30A and 30B extending downwardly from lateral member 73 through lateral support 31 can depress longitudinal members 18A and 18B. Protrusions 30A and 30B are shown in FIGS. 6B and 6C.

FIG. 3B shows a cross-sectional view of the cap/timer assembly shown in FIG. 2B taken generally along line 3B-3B in FIG. 2B. Cap 12 is secured to container 11. Inner portion 32 of cap 12 is surrounded by outer portion 33 of cap 12. Inner portion 32 rests atop lip 34 of outer portion 33 of cap 12. Aperture 41A is arranged within the underneath top surface of inner portion 32 and operatively arranged to receive nut 41 by means of a press fit. Arm 55 of timer 13 fits within nut 41 such that when inner and outer portions 32 and 33 are rotated, nut 41 rotates arm 55 to wind timer 13. Inner portion 32 of cap 12 engages groove 31C of lateral support 31 of cap 12. Groove 31C is arranged between top portion 31A and bottom portion 31B of lateral support 31. Lateral support 31 including top portion 31A, bottom portion 31B and groove 31C are cylindrical such that, as inner portion 32 is rotated by outer portion 33, inner portion 32 is rotatable with respect to lateral support 31 within groove 31C. As described above, timer 13 rests atop lateral support 31 by means of posts and recesses. Gearing mechanism 50 (described in further detail below) is shown between timer 13 and top portion 31A of lateral support 31. Seal 90 is shown securing bottom portion 31B of lateral support 31 to container 11. It should be appreciated that seal 90 is a hermetic seal in a preferred embodiment however, any suitable seal is contemplated. For example, seal 90 can be a heat sealed bar coded prescription label. In a preferred embodiment, seal 90 is a standard adhesive label.

In a preferred embodiment, nut 41 is a custom metal nut made of stainless steel and operatively arranged to prevent stripping between inner portion 32 and arm 55. In a preferred embodiment, timer 13 is a MARKTIME® 19 Series Spring Driven Timing Mechanism, available from M. H. Rhodes, 105 Nutmeg Road South, South Windsor, Conn. 06074, modified to include leg posts 51, 52, 53, and 54 so that timer 13 can stand atop lateral support 31 of cap 12 within recesses R1, R2, R3, and R4. Timer 13 is pre-designed to be rotatable for a specific interval of time, for example, a prescribed dosage period. For example, timer 13 can be pre-designed to rotate for 2, 3, 4, 6, 12, 18, 24, 36, or 48 hours, etc. It should be appreciated that timer 13 can be set for any desired time interval.

Figure 4A:
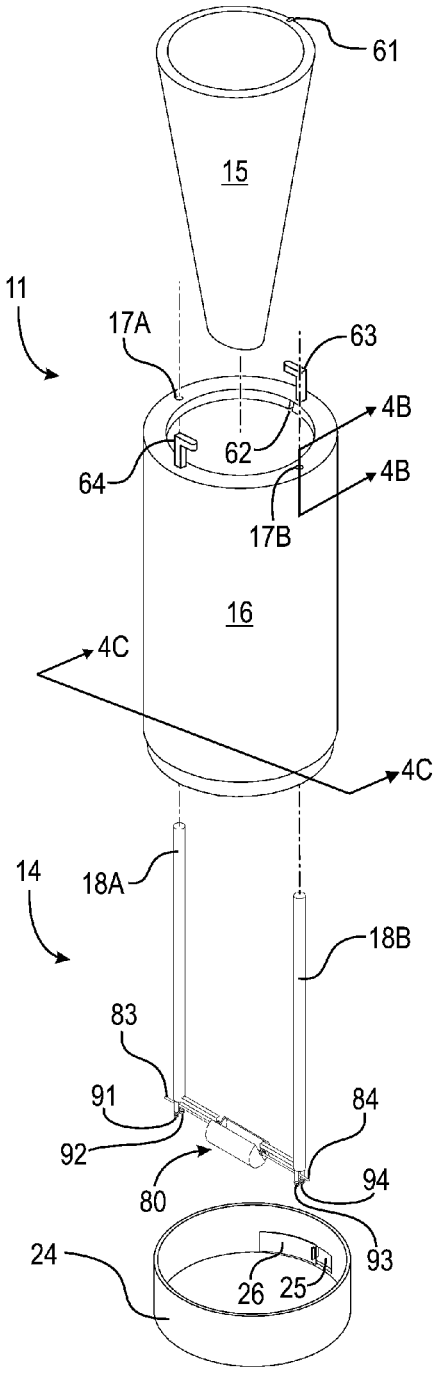
FIG. 4A is an exploded perspective view of the container of the invention.

FIG. 4A shows an exploded perspective view of container 11 including part of dispenser assembly 14. The other part of dispenser assembly 14 is gearing mechanism 50 shown in FIG. 3A. Dispenser assembly 14 broadly includes gearing mechanism 50, longitudinal members 18A and 18B and hopper 80. To dispense pill M, gearing mechanism 50 depresses longitudinal members 18A and 18B, which, in turn, rotate hopper 80. When a pre-determined time interval has elapsed, gearing mechanism 50 raises longitudinal members 18A and 18B, which, in turn, rotate hopper 80 in the opposite direction to collect the next pill to be dispensed. It should be appreciated that longitudinal members 18A and 18B include springs 91, 92, 93 and 94 which allow longitudinal members 18A and 18B to be displaced longitudinally within container 11. However, springs 91, 92, 93 and 94 do not provide an upward force. In other words, as further explained below, when gearing mechanism 50 raises longitudinal members 18A and 18B it is without assistance from springs 91, 92, 93 and 94.

Container 11 includes sleeve 15, outer member 16, through-bores 17A and 17B operatively arranged to align protrusions 30A and 30B with longitudinal members 18A and 18B. Additionally, through-bores 17A and 17B maintain and guide longitudinal members 18A and 18B as they are displaceable in the longitudinal direction. Sleeve 15 is removably arranged within outer member 16 and operatively arranged to hold at least one pill M. It should be appreciated that sleeve 15 is open at the top and bottom to allow pills to be dispensed into hopper 80. Furthermore, it should be appreciated that outer member 16 is also open at the top and bottom to allow pills M (one at a time) to be dispensed into base 24.

In a preferred embodiment, sleeve 15 tapers from top to bottom such that, at the bottom, sleeve 15 is open only to allow pill M, one at a time, to fall into hopper 80. In a preferred embodiment, the contour of the open bottom of sleeve 15 is correspondingly-shaped according to the shape of pill M to be dispensed. For example, the bottom opening of sleeve 15 can be circular for circular pills. Alternatively, the bottom opening of sleeve 15 can be oblong to accommodate oblong pills. Any suitable shape is contemplated. Sleeve 15 is prevented from rotating within outer member 16 by aligning tab 61, which protrudes from the outer surface of sleeve 15; aligning tab 61 fits within notch 62 which is arranged within the inner surface of outer member 16.

Figure 4B:
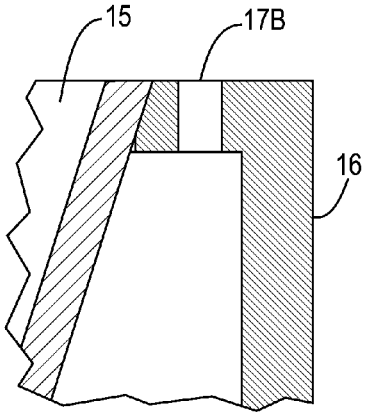
FIG. 4B is a cross-sectional view of a portion of the container shown in FIG. 4A taken generally along the line 4B-4B in FIG. 4A.
Figure 4C:
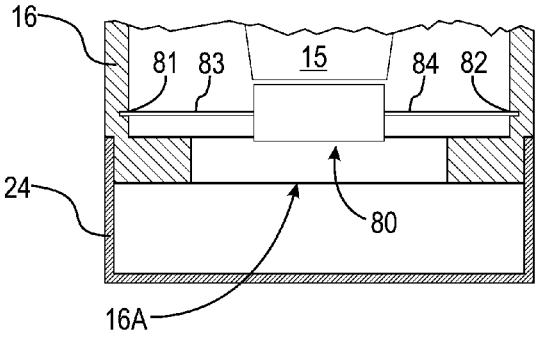
FIG. 4C is a cross-sectional view of the container shown in FIG. 4A taken generally along the line 4C-4C in FIG. 4A.

FIG. 4B shows the top inner surface of outer member 16 which is correspondingly tapered to provide a corresponding fit with the taper of sleeve 15. FIG. 4C shows outer member 16 of container 11 press fitted into base 24. Hopper 80 is securable laterally within outer member 16 by diametrically opposing notches 81 and 82 which are operatively arranged to receive rods 83 and 84 extending outwardly from hopper 80. As previously described, container 16 includes opening 16A arranged at the bottom beneath hopper 80 so that pill M can fall from hopper 80 into base 24.

L-shaped alignment members 63 and 64 are shown in FIGS. 3A and 4A protruding upwardly from the top of outer member 16. L-shaped alignment members 63 and 64 connect container 11 with cap 12 by sliding within arcuate slots 66 and 68, respectively, and hooking atop lateral support 31. To connect outer member 16 and cap 12, cap 12 is positioned atop outer member 16. When L-shaped alignment members 63 and 64 slide through arcuate slots 66 and 68, cap 12 can be rotated with respect to outer member 16 such that L-shaped alignment members 63 and 64 are prevented from further rotating by arcuate slots 66 and 68. Once in this position, container 11 and cap 12 are preferably hermetically sealed. In a preferred embodiment, L-shaped alignment member 63 is arranged diametrically opposite L-shaped alignment member 64.

In a preferred embodiment, longitudinal members 18A and 18B are also arranged diametrically opposite one another. Furthermore, in a preferred embodiment, longitudinal members 18A and 18B are positioned 90 degrees with respect to L-shaped alignment members 63 and 64. Aligning tab 61 and notch 62 are arranged proximate L-shaped alignment member 63. However, it should be appreciated that aligning tab 61 and notch 62 could be arranged anywhere along the inner surface of outer member 16. As described above, longitudinal members 18A and 18B connect gearing 50 within cap 12 with hopper 80.

Figure 5A:
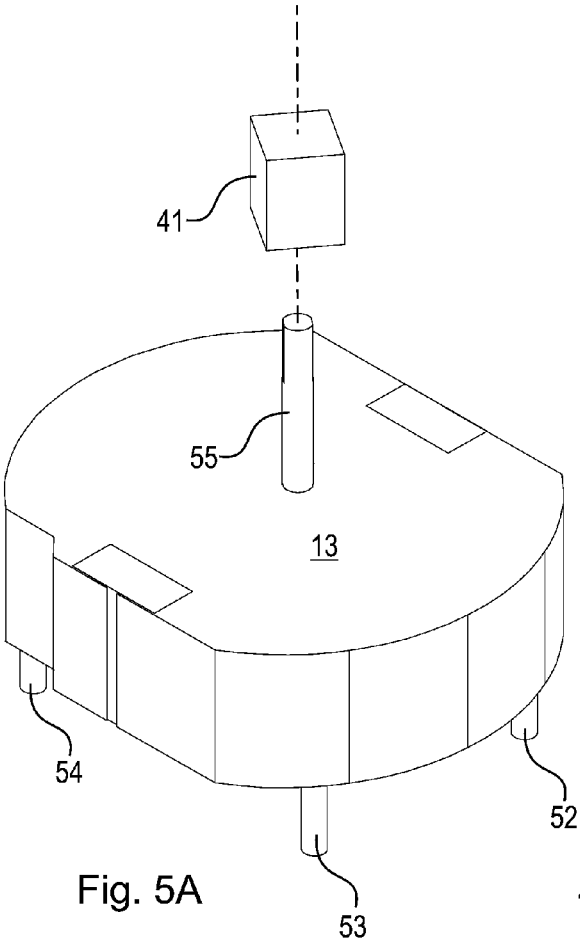
FIG. 5A is a partially-exploded top perspective view of the timer and nut of the invention.
Figure 5B:
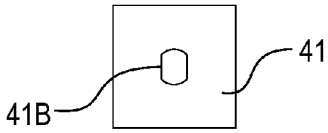
FIG. 5B is a bottom elevational view of the nut of the invention shown in FIG. 5A.
Figure 5C:
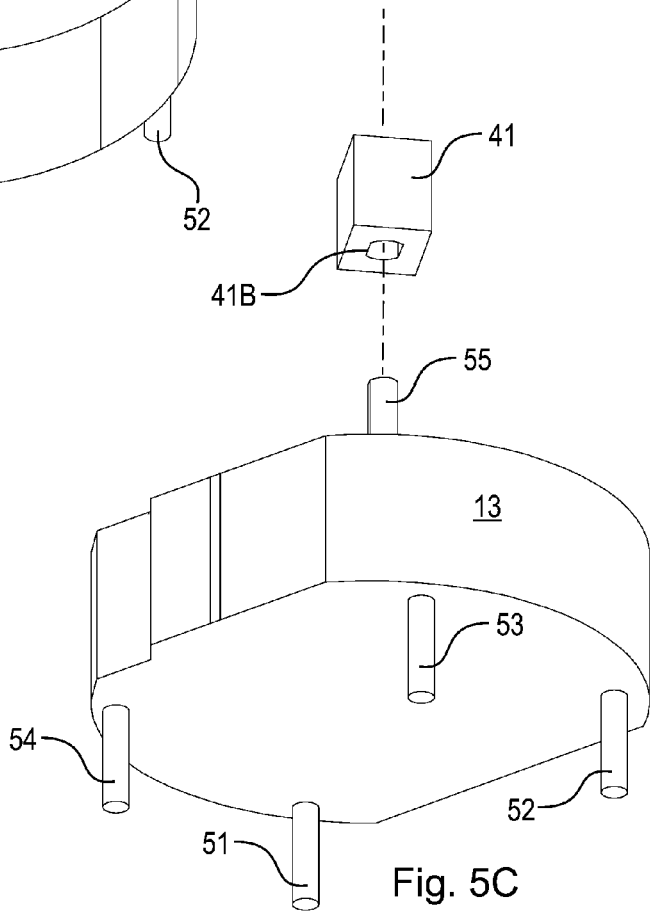
FIG. 5C is a partially-exploded bottom perspective view of the timer and nut of the invention shown in FIG. 5A.

The following should be appreciated from FIGS. 5A through 5C. The top of arm 55 of timer 13 is securable to nut 41 such that when nut 41 rotates with cap 12, arm 55 of timer 13 rotates. In a preferred embodiment, the lateral cross-section of the top of arm 55 is circular barrel shaped. In other words, the lateral cross-section of the top of arm 55 is substantially circular except two opposing parallel sides are flattened. As previously described and shown in FIG. 5B, nut 41 includes custom shaped indent 41B to prevent arm 55 from stripping. Any suitable custom shape is contemplated. Leg posts 51, 52, 53 and 54 are shown protruding downwardly from timer 13.

Figure 6A:
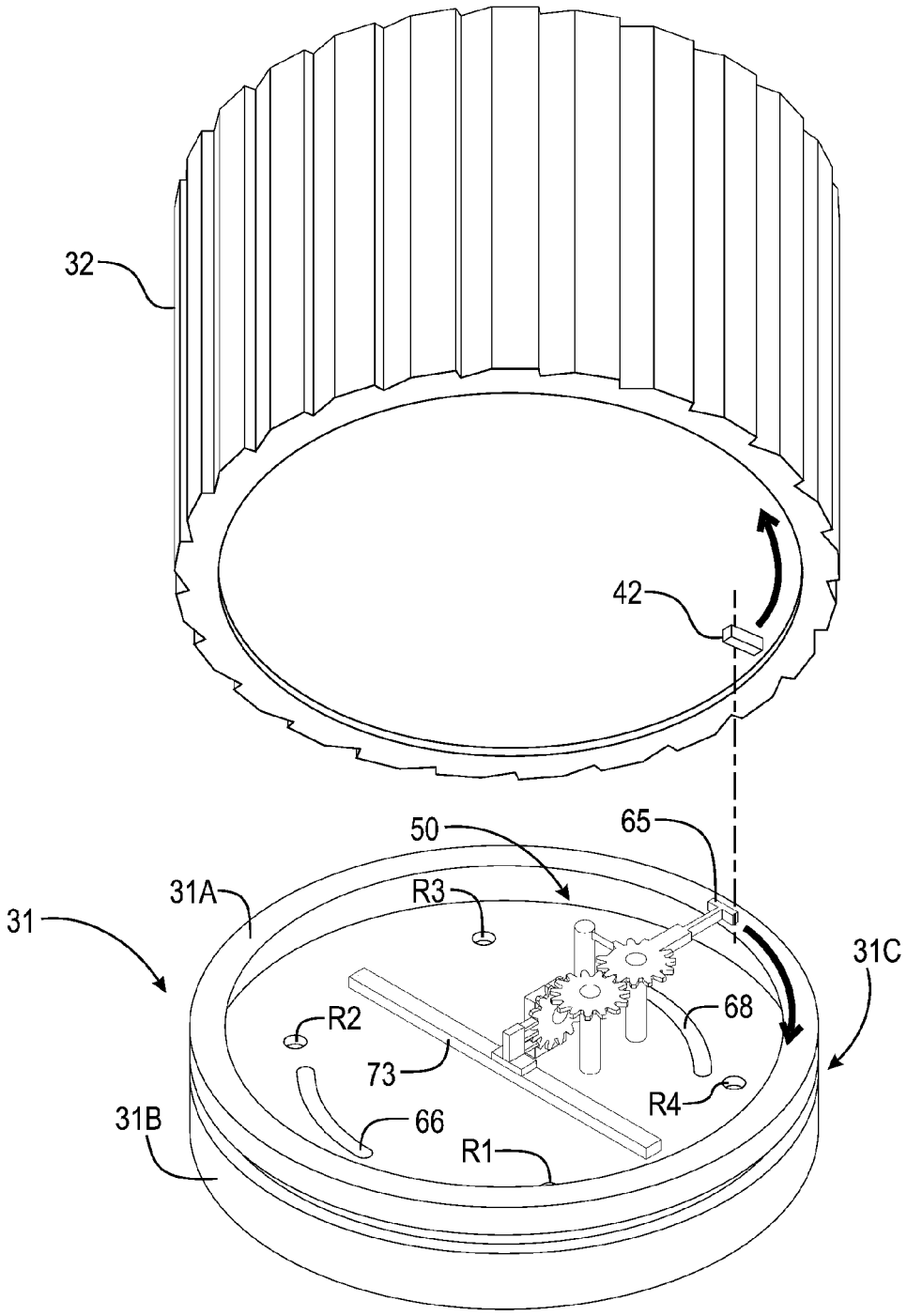
FIG. 6A is a perspective view of the gearing mechanism within the cap of the invention showing the front portion of the cap tilted upwards.
Figure 6B:
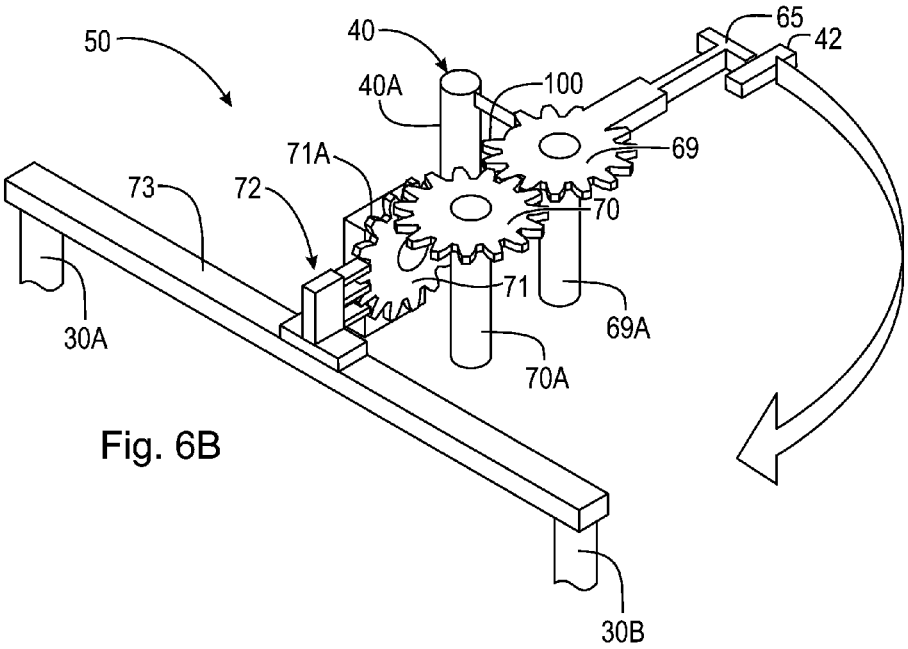
FIG. 6B is a perspective view of the gearing mechanism shown in FIG. 6A at rest with respect to the extension of the inner portion of the cap.
Figure 6C:
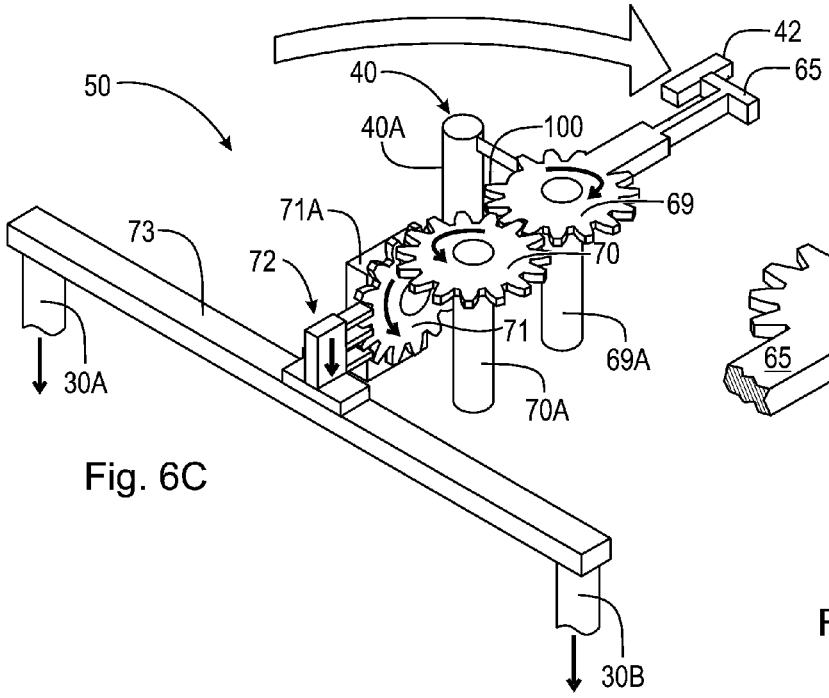
FIG. 6C is a perspective view of the extension of the inner portion of the cap shown in FIG. 6B contacting the gearing mechanism shown in FIG. 6B.

FIG. 6A shows inner portion 32 of cap 12 including extension 42. Timer 13 is not shown and inner portion 32 is tilted upward atop lateral support 31. It should be appreciated by referring to FIG. 3B, that inner portion 32 secures to lateral support 31 by hooking under top portion 31A and resting within groove 31C atop bottom portion 31B. As shown in FIG. 6A, when apparatus 10 is at rest, extension 42 aligns immediately downstream or clockwise of T-shaped member 65 of gearing 50. When inner portion 32 of cap 12 is rotated to dispense pill M and set a time interval, extension 42 rotates clockwise in the direction shown. It should be appreciated that, in a preferred embodiment, since extension 42 at rest sits clockwise of gearing 50, extension 42 does not contact gearing 50 until extension 42 is rotated almost 360 degrees. Extension 42 contacts T-shaped member 65 as inner portion 32 is rotated.

Gearing 50 is further shown in FIGS. 6B and 6C. In addition to T-shaped member 65, gearing 50 includes first sequential gear 69, second sequential gear 70, third sequential gear 71, and rung member 72. First sequential gear 69, second sequential gear 70, and third sequential gear 71 mesh to transmit rotational motion. Gearing 50 further includes lateral member 73 which connects rung member 72 to protrusions 30A and 30B which protrude within through-bores 17A and 17B of outer member 16 to longitudinal members 18A and 18B and then to hopper 80. FIG. 6B shows gearing 50 when apparatus 10 is at rest. As extension 42 is rotated clockwise gearing 50 is stationary. Until extension 42 is rotated to the position shown in FIG. 6C, gearing 50 is stationary. Beginning at the point of contact shown in FIG. 6C between extension 42 and T-shaped member 65, first sequential gear 69 is rotated in the direction shown. Rotation of first sequential gear 69 rotates second sequential gear 70 in the direction shown. Rotation of second sequential gear 70 rotates third sequential gear 71. Rotation of third sequential gear 71 displaces rung member 72 in the direction shown. Displacement of rung member 72 depresses lateral member 73, which, in turn depresses protrusions 30A and 30B and longitudinal members 18A and 18B. It should be appreciated that first sequential gear 69 and second sequential gear 70 rotate in the same plane as extension 42 and T-shaped member 65. Third sequential gear 71 is rotated in a plane that is perpendicular to the plane of rotation of first sequential gear 69, second sequential gear 70, extension 42 and T-shaped member 65. First sequential gear 69 and second sequential gear 70 are elevated atop the top surface of lateral support 31 by supports 69A and 70A, respectively (see also FIG. 6A). Third sequential gear 71 is supported by support 71A.

Figure 6D:
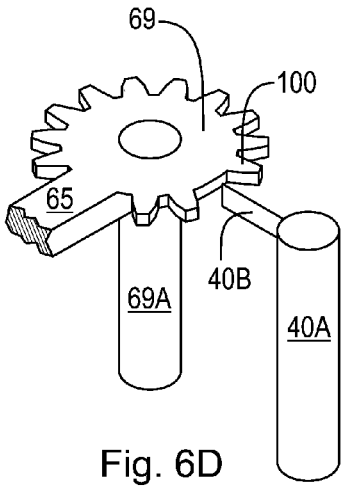
FIG. 6D is a perspective view of the gear/chime assembly of the invention.

FIGS. 6B, 6C, and 6D show chime 40 arranged to engage first sequential gear 69. Chime 40 includes support 40A and tine 40B. Tine 40B of chime 40 is arranged to be contacted by cog 100 of first sequential gear 69.

Figure 7A:
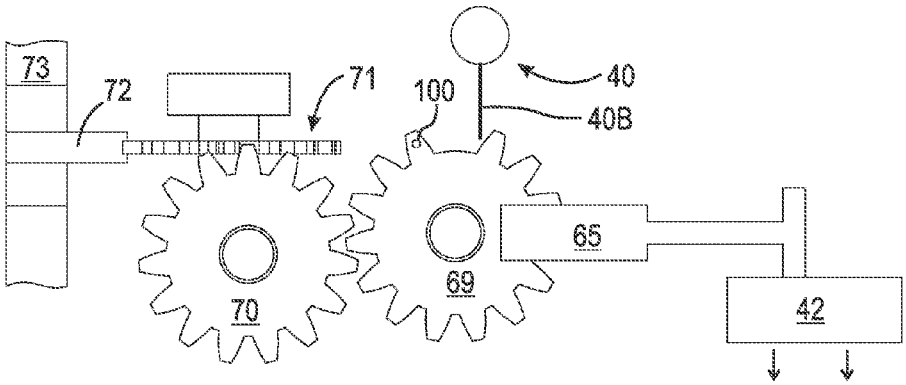
FIG. 7A is a top down view of the gearing mechanism at rest with respect to the extension of the inner portion of the cap shown in FIG. 6B.
Figure 7B:
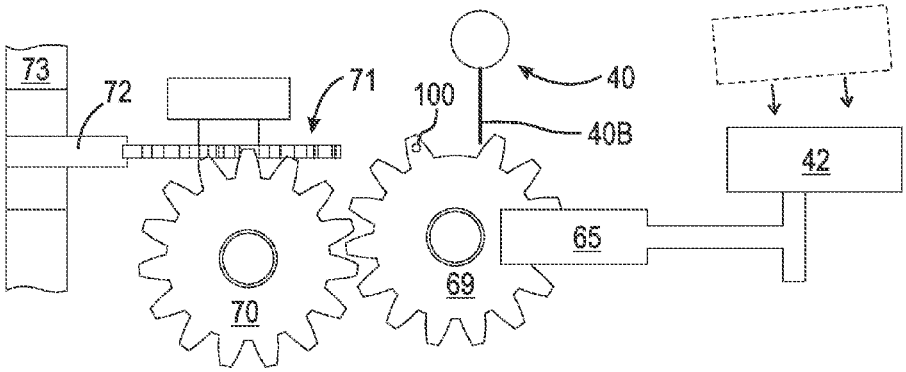
FIG. 7B is a top down view of the extension of the inner portion of the cap contacting the gearing mechanism shown in FIG. 6C.

The following should be appreciated in view of FIGS. 7A through 7H. FIG. 7A corresponds with the gearing mechanism 50 shown in FIG. 6B. In both Figures, extension 42 is immediately downstream, or clockwise, of T-shaped member 65. Gearing mechanism 50 is at rest or stationary. FIG. 7B corresponds with the gearing mechanism 50 shown in FIG. 6C. In both Figures, extension 42 has rotated almost 360 degrees and extension 42 is about to contact T-shaped member 65. As shown in both FIGS. 7A and 7B, cog 100 and T-shaped member 65 and all the other components are unchanged except for extension 42. FIG. 7B shows extension 42 moving toward and contacting T-shaped member 65.

Figure 7C:
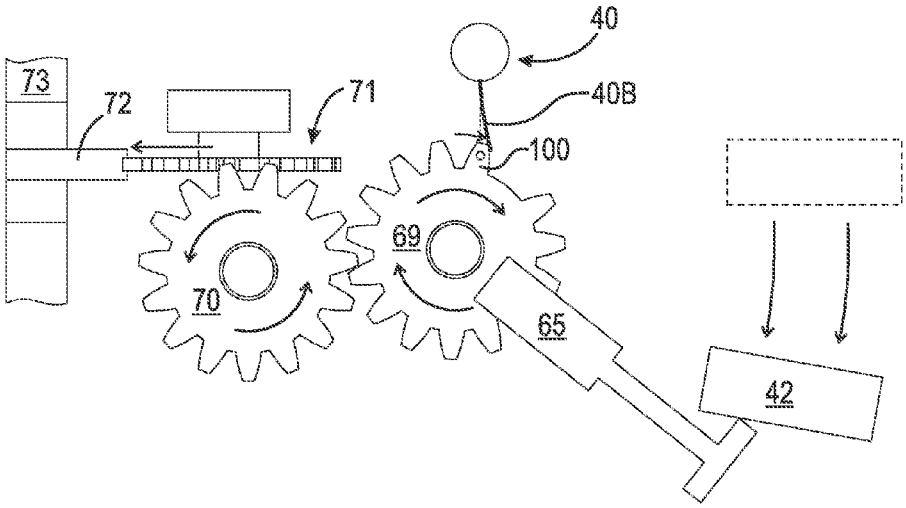
FIG. 7C is a top down view of the extension of the inner portion of the cap actuating the gearing mechanism shown in FIG. 6C.

FIG. 7C shows gearing 50 as extension 42 pushes T-shaped member 65. As cap 12 is fully rotated to set the time interval, extension 42 pushes T-shaped member 65. T-shaped member 65 is connected to first sequential gear 69. Accordingly, as T-shaped member 65 is pushed clockwise, first sequential gear 69 is rotated clockwise in the direction shown. Similarly, cog 100 rotates and contacts tine 40B of chime 40. Due to meshing, as first sequential gear 69 is rotated, second sequential gear 70 is rotated as is third sequential gear 71. Rung member 72 and lateral member 73 depress protrusions 30A and 30B and longitudinal members 18A and 18B which rotate hopper 80 (shown in FIG. 8A).

Figure 7D:
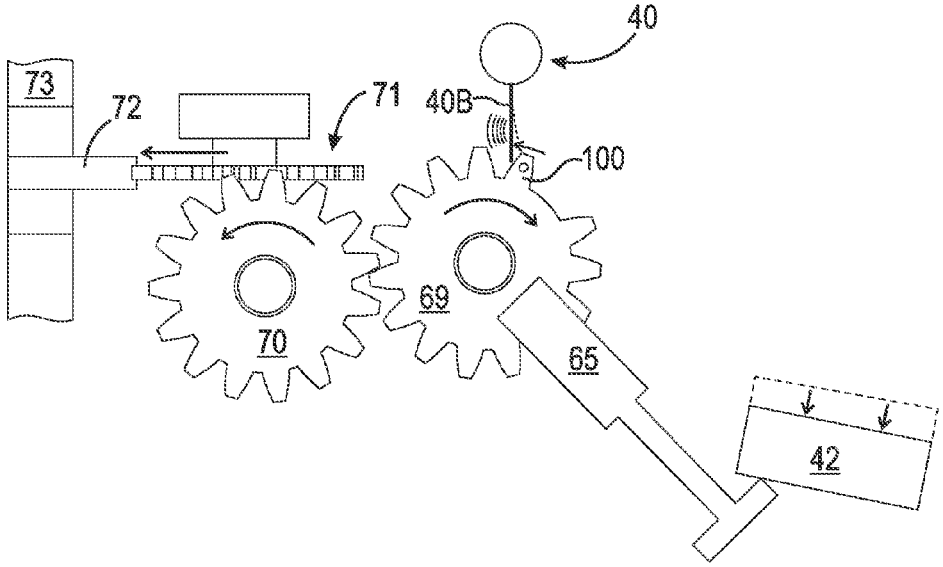
FIG. 7D is a top down view of the extension of the inner portion of the cap causing the chime of the invention to be actuated.
Figure 10A:
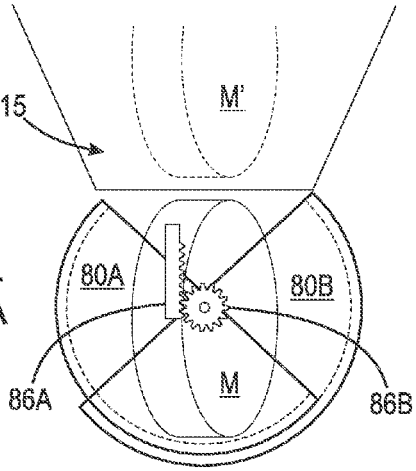
FIG. 10A is a schematic view of the first end of the hopper shown in FIG. 9 at rest arranged beneath the sleeve of the container.
Figure 10B:
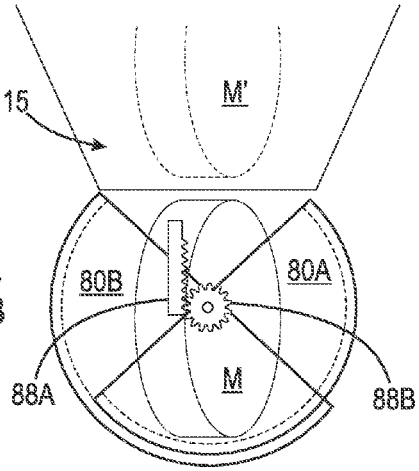
FIG. 10B is a schematic view of the second end of the hopper shown in FIG. 9 at rest arranged beneath the sleeve of the container.

FIG. 7D shows a preferred embodiment where extension 42 fully rotates T-shaped member 65. In this position, cog 100 causes tine 40B of chime 40 to create an audible sound such that user U can be alerted that the time interval has been set and pill M has been dispensed into base 24. In this position, as shown in FIGS. 10E and 10F, due to the rotation gearing 50 and depression of longitudinal members 18A and 18B, respectively, hopper 80 is rotated to release one pill M.

Figure 7E:
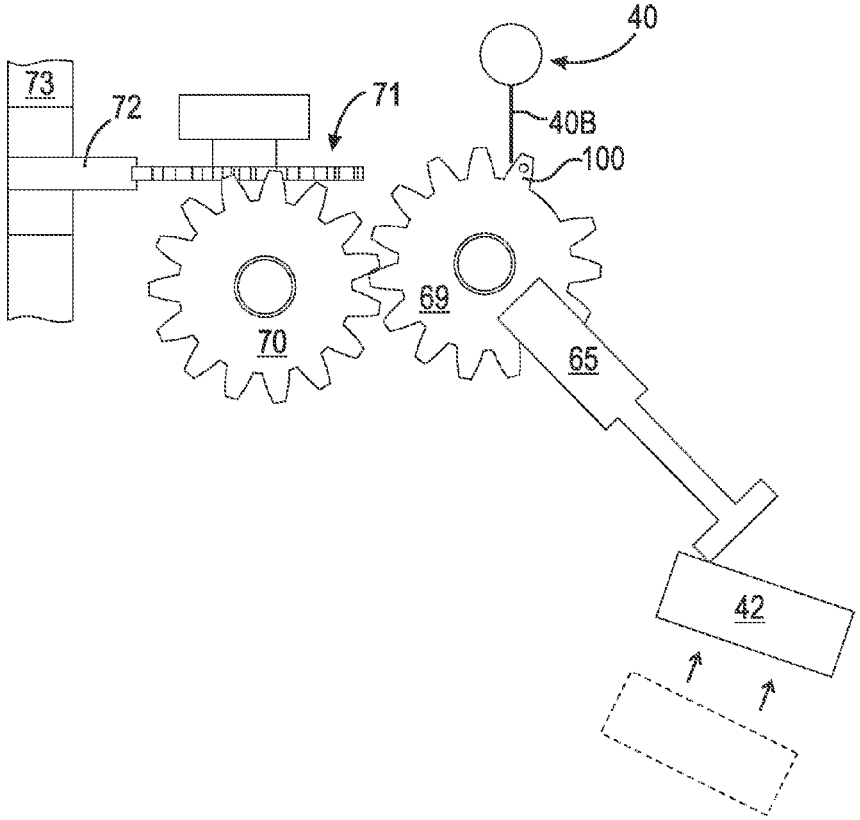
FIG. 7E is a top down view of the extension of the inner portion of the cap contacting the gearing mechanism before a time interval has elapsed.

Once hopper 80 has been rotated to release one pill and the timer interval has been set, timer 13 begins to run for the duration of the time interval and cap 12 including extension 42 slowly rotates counter-clockwise. FIG. 7E shows the positioning of gearing 50 and extension 42 before the time interval has elapsed (before extension 42 has returned 360 degrees). It should be appreciated that gearing 50 is in the same position as shown in FIG. 7D where extension 42 fully extends T-shaped member 65. Gearing 50 is stationary while the time interval runs until extension 42 returns and contacts T-shaped member 65. While extension 42 rotates counter-clockwise between the positions of FIGS. 7D and 7E, respectively, springs 91, 92, 93 and 94 do not raise longitudinal members 18A and 18B.

Figure 7F:
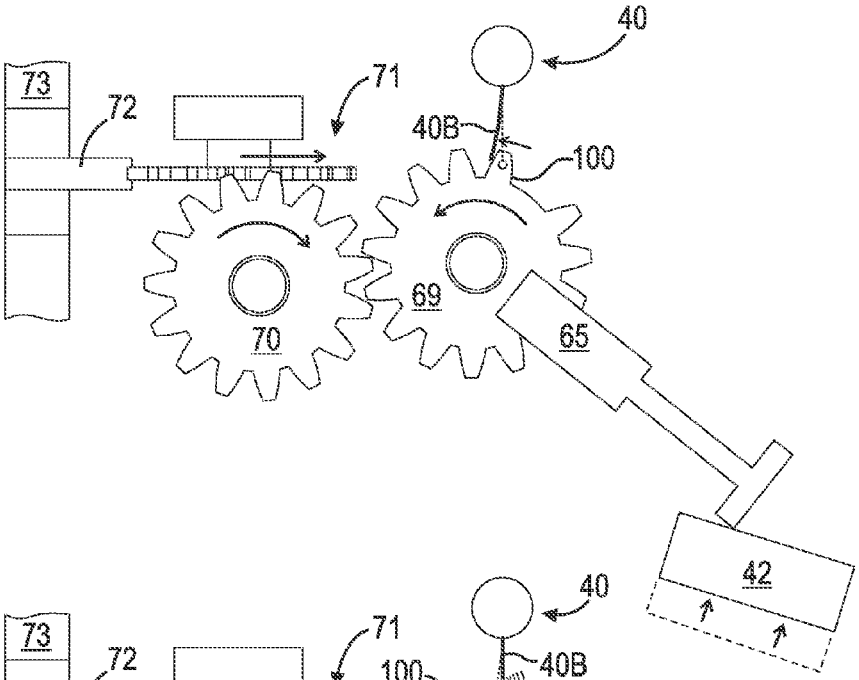
FIG. 7F is a top down view of the extension of the inner portion of the cap engaging the gearing mechanism before a time interval has elapsed.
Figure 7G:
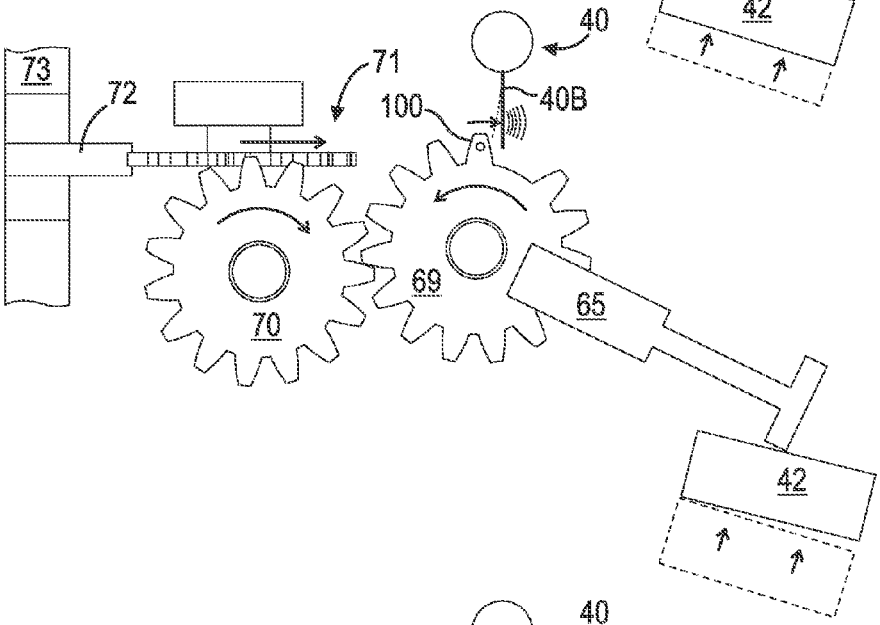
FIG. 7G is a top down view of the extension of the inner portion of the cap causing the chime of the invention to be actuated as a time interval elapses.
Figure 7H:
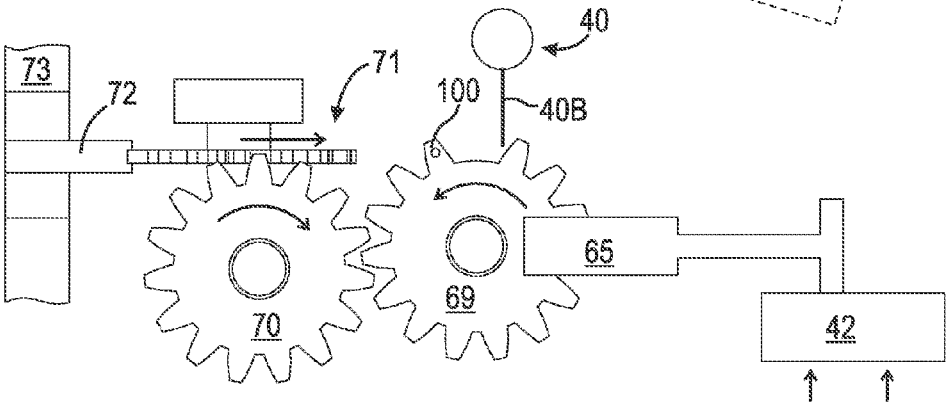
FIG. 7H is a top down view of the extension of the inner portion of the cap at rest with respect to the gearing mechanism after a time interval has elapsed.

FIGS. 7F through 7H show extension 42 pushing T-shaped member 65 as the time interval elapses. As T-shaped member 65 is moved counter-clockwise, first sequential gear 69 is moved counter-clockwise. Due to meshing, second sequential gear 70 is rotated clockwise and third sequential gear 71 is rotated. As third sequential gear 71 is rotated in the direction shown, rung member 72 is raised. As rung member 72 is raised, lateral member 73 is raised. Since lateral member 73 is connected to longitudinal members 18A and 18B via protrusions 30A and 30B, as lateral member 73 is raised, longitudinal members 18A and 18B are raised. The raising of longitudinal members 18A and 18B causes hopper 80 to rotate to receive the next pill.

As shown in FIG. 7G, as extension 42 pushes T-shaped member 65 to its original position (shown in FIG. 7A), cog 100 causes tine 40B of chime 40 to create an audible sound such that user U can be alerted that the time interval has elapsed. In the position shown in FIG. 7H, apparatus 10 can be set to another time interval and the next pill can be accessed by rotating cap 12 with respect to container 11 once again.

Figure 8A:
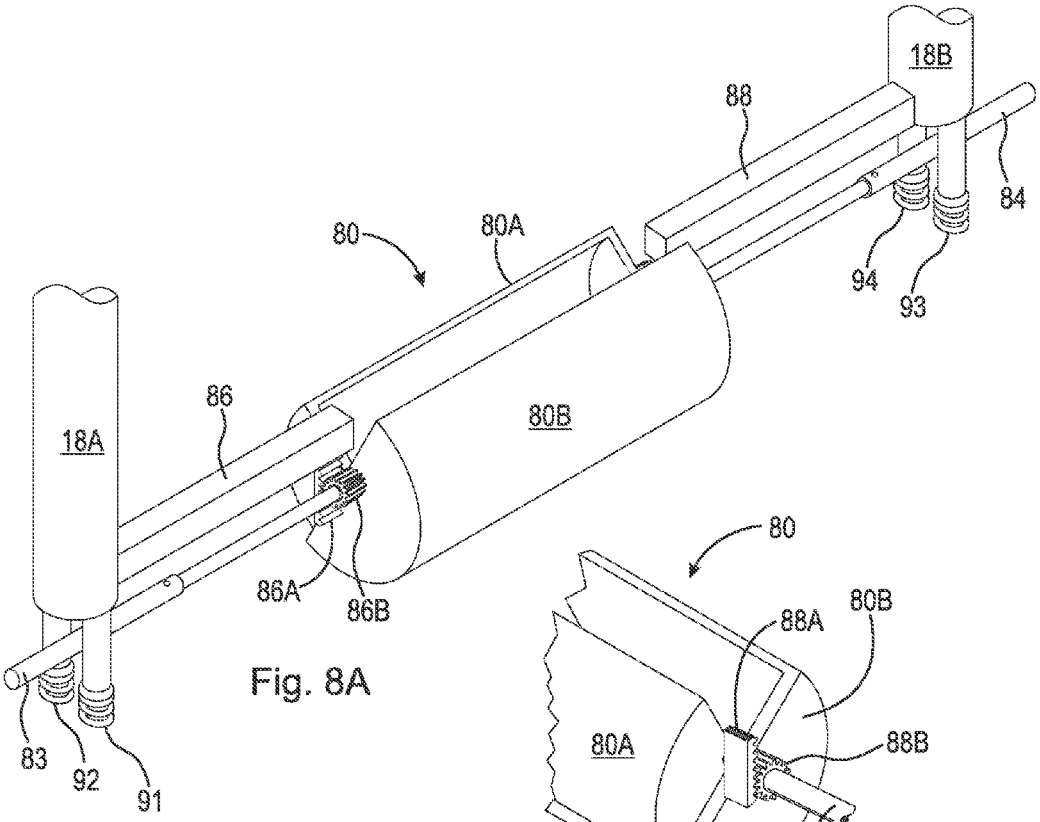
FIG. 8A is a left side perspective view of the hopper of the invention at rest.

FIG. 8A shows hopper 80 arranged between longitudinal members 18A and 18B. Hopper 80 includes half 80A and half 80B where half 80A is rotatable within half 80B. Rod 83 extends from notch 81 arranged within outer member 16

(shown in FIG. 4C) and connects to half 80B of hopper 80. Rod 84 extends from notch 82 arranged within outer member 16 and preferably diametrically opposed to notch 81, and connects to half 80A of hopper 80. Rods 83 and 84 include two parts which can telescope. Rods 83 and 84 include springs that offer compression for the telescoping portion connected to gears 86B and 88B.

Figure 8B:
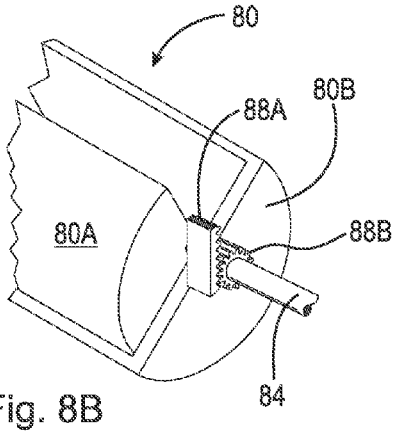
FIG. 8B is a fragmented right side perspective view of the hopper shown in FIG. 8A.
Figure 9:
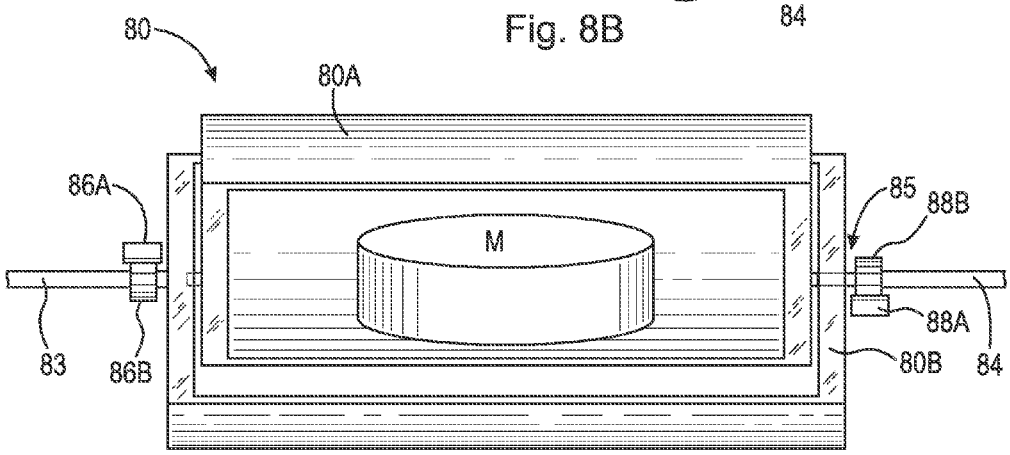
FIG. 9 is a top down view of the hopper shown in FIG. 8A.

Since half 80A is arranged within half 80B, rod 84 connects to half 80A via through-bore 85 as shown in FIG. 9. The depression and elevation of longitudinal member 18A via gearing 50 described above controls the rotation of half 80B. On the other side, the depression and elevation of longitudinal member 18B via gearing 50 controls the rotation of half 80A. As shown in FIG. 8A, from a left side perspective view, plunging gear 86A is arranged on the left of gear 86B. As shown in FIG. 8B, from a right side perspective view, plunging gear 88A is arranged on the left of gear 88B. As shown in FIG. 9, from a top view, plunging gears 86A and 88A are arranged on opposite sides of rods 83 and 84, respectively. Half 80A is secured within half 80B proximate rod 83 via protrusion and notch.

Rods 83 and 84 secure hopper 80 within container 11. The displacement of longitudinal members 18A and 18B by gearing 50 causes hopper 80 to rotate. As longitudinal member 18A is depressed, extremity 86, which protrudes from longitudinal member 18A, depresses. As extremity 86 depresses, plunging gear 86A depresses and rotates gear 86B via meshing. Since gear 86B is secured to half 80B of hopper 80, as gear 86B rotates, half 80B rotates. Simultaneously, as longitudinal member 18A is depressed, longitudinal member 18B is depressed; extremity 88, which protrudes from longitudinal member 18B, depresses. As extremity 88 depresses, plunging gear 88A depresses and rotates gear 88B via meshing. Since gear 88B is secured to half 80A of hopper 80, as gear 88B rotates, half 80A rotates.

In the resting state when gearing 50 is positioned according to FIG. 7A and hopper 80 is positioned according to FIG. 8A, hopper 80 is open facing upward. In a preferred embodiment, pill M is already within hopper 80 between half 80A and half 80B as shown in FIG. 9. As shown in FIGS. 10A and 10B, next pill M' is waiting atop hopper 80 within sleeve 15. FIG. 10A shows the left side view of hopper 80 shown in FIG. 8A. FIG. 10B shows the right side view of hopper 80 shown in FIG. 8A. FIGS. 10A and 10B show opposite ends of hopper 80 when apparatus 10 is at rest and hopper 80 is ready to be rotated.

Figure 10C:
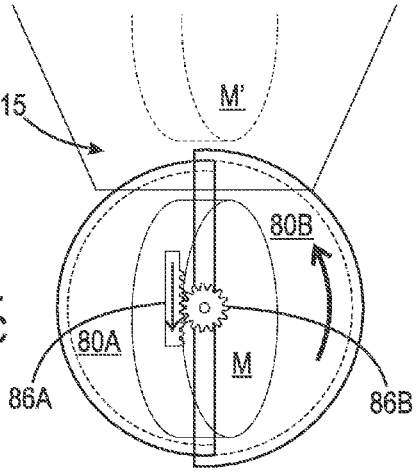
FIG. 10C is a schematic view of the first end of the hopper shown in transition arranged beneath the sleeve of the container.
Figure 10D:
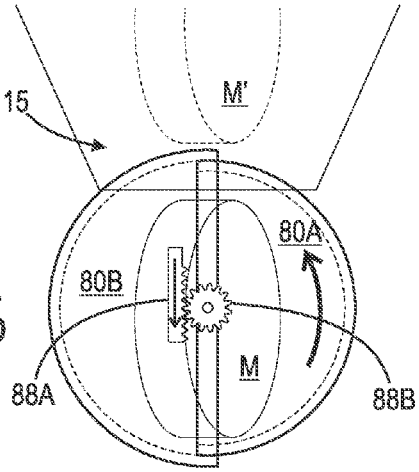
FIG. 10D is a schematic view of the second end of the hopper shown in transition arranged beneath the sleeve of the container.
Figure 10E:
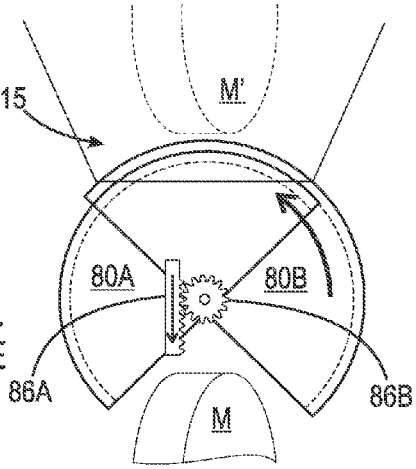
FIG. 10E is a schematic view of the first end of the hopper shown fully actuated arranged beneath the sleeve of the container.
Figure 10F:
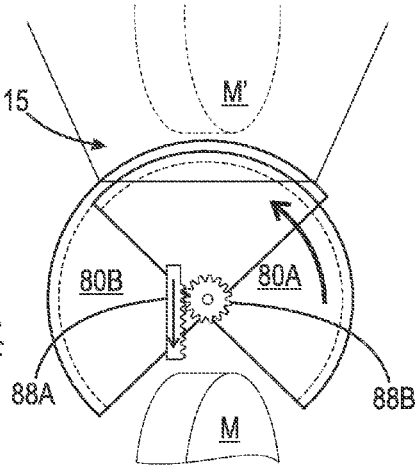
FIG. 10F is a schematic view of the second end of the hopper shown fully actuated arranged beneath the sleeve of the container.

FIGS. 10C and 10D show opposite ends of hopper 80, respectively, when apparatus 10 is rotating to dispense pill M. The position of hopper 80 in FIGS. 10C and 10D corresponds with the position of gearing 50 shown in FIG. 7C. In order to rotate half 80A and half 80B, longitudinal members 18A and 18B depress via gearing 50 as described above. As longitudinal members 18A and 18B depress, plunging gears 86A and 88A depress and rotate gears 86B and 88B, respectively. As shown in FIG. 10C, plunging gear 86A and gear 86B only rotate half 80B. Simultaneously, as shown in FIG. 10D, plunging gear 88A and gear 88B only rotate half 80A.

FIGS. 10E and 10F show opposite ends of hopper 80, respectively, when apparatus 10 is rotated to dispense pill M. The position of hopper 80 in FIGS. 10E and 10F corresponds with the position of gearing 50 shown in FIG. 7D. Once half 80A and half 80B are fully rotated, pill M is released into base 24 arranged beneath hopper 80. User U can access pill M via door 26. Door 26 preferably remains closed by means of friction however, user U can manually open door 26. As described above, once hopper 80 has been rotated to release one pill M and the timer interval has been set, timer 13 begins to run for the duration of the time interval and cap 12 including extension 42 slowly rotates counter-clockwise. Throughout the counter-clockwise movement, half 80A and half 80B remain in the positions shown in FIGS. 10E and 10F. As gearing 50 is actuated by extension 42 (as shown in FIGS. 7F through 7H), half 80A and half 80B are rotated from the downward facing open position (shown in FIGS. 10E and 10F) to the upward facing open position (shown in FIGS. 10A and 10B). Longitudinal members 18A and 18B are raised via gearing 50 as described above. As longitudinal members 18A and 18B are raised, plunging gears 86A and 88A are raised and gears 86B and 88B rotate half 80A and 80B, respectively. After pill M is dispensed into base 25 and the time interval has elapsed, next pill M' is within hopper 80 and ready to be dispensed. The process of dispensing a pill can be repeated.

Figure 11:
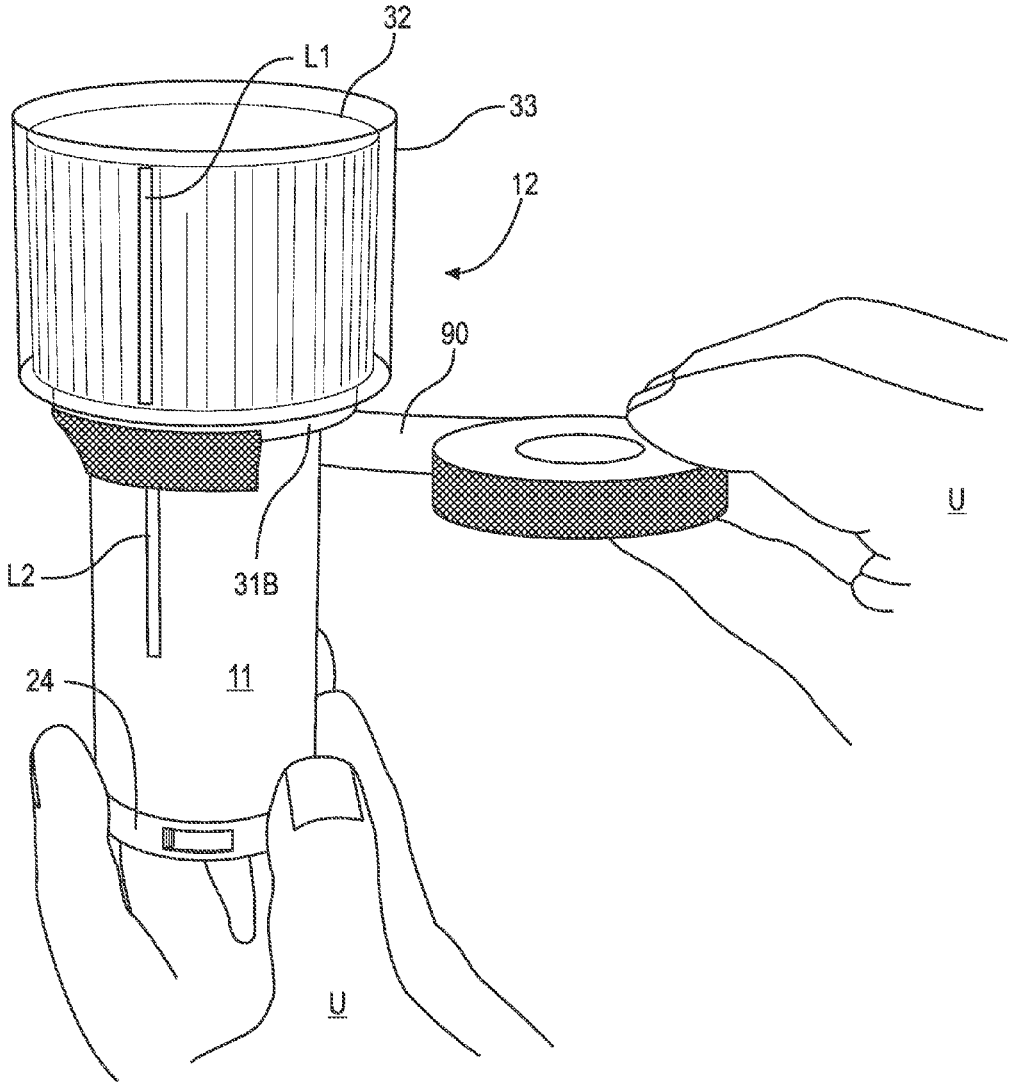
FIG. 11 is a perspective view of the seal of the invention being applied to the apparatus of the invention.

FIG. 11 shows seal 90 being applied to apparatus 10. User U can be a pharmacist, for example. Once applied, if the seal is intact, it is an indication that apparatus 10 has not been tampered with.

Figure 12A:
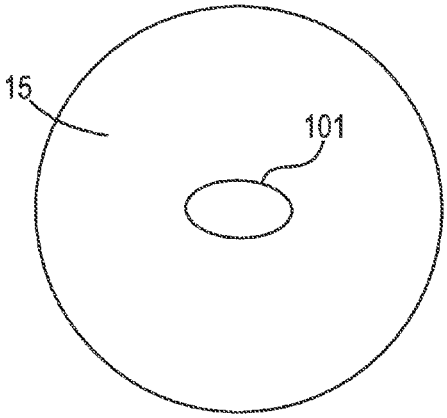
FIG. 12A is a top down view of an alternate embodiment of a sleeve of the invention.
Figure 12B:
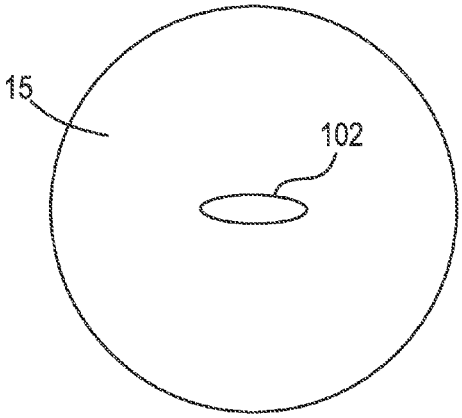
FIG. 12B is a top down view of an alternate embodiment of a sleeve of the invention.
Figure 12C:
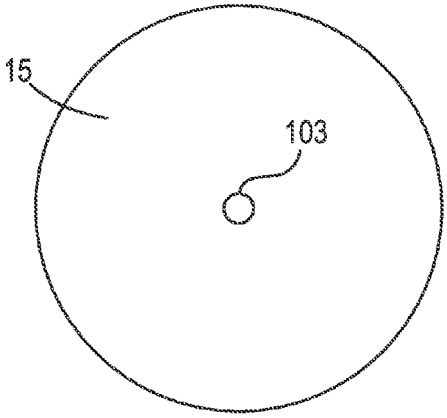
FIG. 12C is a top down view of an alternate embodiment of a sleeve of the invention.
Figure 12D:
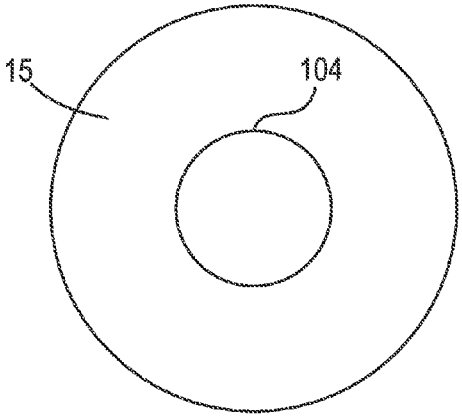
FIG. 12D is a top down view of an alternate embodiment of a sleeve of the invention; and, FIG. 12E is a top down view of an alternate embodiment of a sleeve of the invention.
Figure 12E:
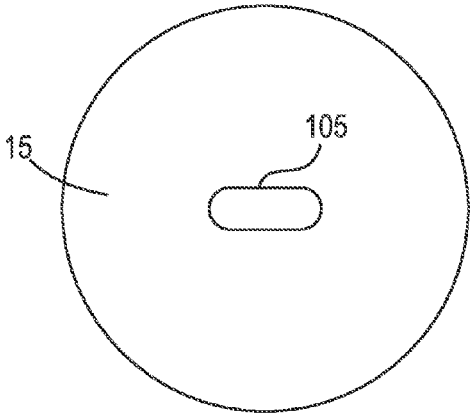

FIGS. 12A through 12E show a variety of alternate embodiments of sleeve 15 from the top view. It should be appreciated that sleeve 15 maintains substantially the same outer diameter. However, the opening at the bottom of sleeve 15 can be modified to accommodate pills of differing shapes. FIG. 12A shows sleeve 15 with opening 101 which is oval shaped. FIG. 12B shows sleeve 15 with opening 102 which has an elongated oval shape. FIG. 12C shows sleeve 15 with opening 103 which is circular. FIG. 12D shows sleeve 15 with opening 104 which has an enlarged circular shape. FIG. 12E shows sleeve 15 with opening 105 which has oval barrel shape. It should be appreciated that sleeve 15 can be modified to accommodate all different sized and shaped pills M. In a preferred embodiment, sleeve 15 can hold approximately 240 pills. Although, it should be appreciated that the dimensions of apparatus 10, including the dimensions of sleeve 15, can be adjusted to accommodate a smaller or larger number of pills M. Additionally, the size and shape of pills M can affect the dimensions. It should be appreciated that the components of apparatus 10 are made of plastic except for the springs, gears, seal 90 and timer 13.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

REFERENCE NUMERALS

10 apparatus
M pill
M' next pill
11 container
12 cap
13 timer
14 dispenser assembly
U user
15 sleeve
16 outer member
16A opening
17A protrusion
17B protrusion
18A longitudinal member

18B longitudinal member
24 base
25 opening
26 door
D1 direction
D2 direction
30A protrusion
30B protrusion
31 lateral support
31A top
31B bottom
31C groove
32 inner portion
32A lip
33 outer portion
34 lip
40 chime
40A support
40B tine
41 nut
41A aperture
41B custom shaped indent
42 extension
L1 portion of alignment line
L2 portion of alignment line
50 gearing
51 leg post
52 leg post
53 leg post
51 leg post
R1 recess
R2 recess
R3 recess
R4 recess
55 arm
62 tab
62 notch
63 L-shaped alignment member
64 L-shaped alignment member
65 T-shaped member
66 arcuate slot
68 arcuate slot
69 first sequential gear
69A support
70 second sequential gear
70A support
71 third sequential gear
71A support
72 rung member
73 lateral member
80 hopper
80A half
80B half
81 notch
82 notch
83 rod
84 rod
85 through bore
86 extremity
86A plunging gear
86B gear
88 extremity
88A plunging gear
88B gear
90 seal
91 spring
92 spring
93 spring
94 spring
100 cog
101 opening
102 opening
103 opening
104 opening
105 opening

What is claimed is:

1. A pill dispenser, comprising:

a container operatively arranged to hold at least one pill, said container including a sleeve having a sidewall tapering from a first opening to a second opening;

a cap/timer assembly rotatably secured to said container, said cap/timer assembly arranged to be set to a time interval for dispensing said at least one pill;

means for alerting a user when said timer has been set to said time interval; and, a dispenser housed within said container and said cap, said dispenser operatively arranged to dispense only one pill at the beginning of said time interval, and to prevent dispensing until said time interval has elapsed.

2. The pill dispenser recited in claim 1, wherein said sleeve is removable.

3. The pill dispenser recited in claim 1 further comprising means for alerting a user when said time interval has elapsed.

4. The pill dispenser recited in claim 3, wherein said means for alerting a user when said time interval has elapsed is a chime.

5. The pill dispenser recited in claim 1 further comprising means for visually indicating to a user that said timer interval has elapsed and said pill can be dispensed.

6. The pill dispenser recited in claim 1, wherein said cap/timer assembly is rotatable in a clockwise direction with respect to said container.

7. The pill dispenser recited in claim 1, wherein said container is securable to said cap by a hermetic seal.

8. The pill dispenser recited in claim 1, wherein said cap/timer assembly is rotated 360 degrees to set a time interval and to dispense said at least one pill.

9. The pill dispenser recited in claim 1, wherein said cap/timer assembly is rotatable in a single direction.

10. A pill dispenser, comprising:

a container operatively arranged to hold at least one pill, said container including a sleeve having a sidewall tapering from a first opening to a second opening;

a cap/timer assembly rotatably secured to said container, said cap/timer assembly arranged to be set to a time interval for dispensing said at least one pill;

a dispenser housed within said container and said cap, said dispenser operatively arranged to dispense only one pill at the beginning of said time interval, and to prevent dispensing until said time interval has elapsed; and, means for alerting a user when said time interval has elapsed.

11. The pill dispenser recited in claim 10, wherein said sleeve is removable.

12. The pill dispenser recited in claim 10 further comprising means for alerting a user when said timer has been set to said time interval.

13. The pill dispenser recited in claim 12, wherein said means for alerting a user when said timer has been set to said time interval is a chime.

14. The pill dispenser recited in claim 10, wherein said cap/timer assembly is rotatable in a single direction.

15. The pill dispenser recited in claim 10, wherein said cap/timer assembly is rotatable 360 degrees to set a time interval and to dispense said at least one pill.

16. The pill dispenser recited in claim 10 further comprising means for visually indicating to a user that said time interval has elapsed and said pill can be dispensed.

17. The pill dispenser recited in claim 10, wherein said dispenser is securable to said cap assembly by a hermetic seal.

18. A method for dispensing a pill from a pill bottle, comprising the steps of:

(a) twisting a cap of said pill bottle containing a timer in a first direction such that said cap and said timer are rotated a predetermined amount relative to a container of said pill bottle;

(b) releasing a pill from a hopper within the container of said pill bottle into a bottom of said container;

(c) activating an indicator;

(d) accessing said pill from an opening in said bottom of said container of said pill bottle;

(e) waiting a predetermined amount of time until said cap of said pill bottle returns in a second direction to its original position so that another pill is received from a sleeve within said container into said hopper to be released, said sleeve having a sidewall tapering from a first opening to a second opening and activating said indicator again; and, (f) repeating steps (a) through (e) as needed.

19. The method recited in claim 18 wherein said predetermined amount is 360 degrees.

20. The method recited in claim 18, wherein said indicator is a chime.

21. The method recited in claim 18, wherein said first direction is clockwise and said second direction is counterclockwise.

* * * * *